United States Patent [19]

Carbone

[11] 4,264,994

[45] May 5, 1981

[54] ARTICULATED FLIPPERS FOR HANDS AND FEET, WITH A SURFACE VARIABLE DURING SWIMMING

[76] Inventor: Giovanni M. Carbone, Via Candore, 59, Messina, Italy

[21] Appl. No.: 921,992

[22] Filed: Jul. 5, 1978

[30] Foreign Application Priority Data

Jul. 6, 1977 [IT] Italy ..... 18704 A/77
Jun. 21, 1978 [IT] Italy ..... 49970 A/78

[51] Int. Cl.[3] ..... A63B 31/10
[52] U.S. Cl. ..... 9/309; 9/308
[58] Field of Search ..... 9/309, 301–308

[56] References Cited

U.S. PATENT DOCUMENTS

| | | | |
|---|---|---|---|
| 2,317,886 | 4/1943 | Coddington | 9/308 |
| 2,726,410 | 12/1955 | Adamopoulos | 9/308 |
| 2,898,611 | 8/1959 | Mooney | 9/304 |
| 2,980,926 | 4/1961 | Wolshin | 9/304 |
| 3,068,499 | 12/1962 | Biskupsky | 9/309 |
| 3,261,040 | 7/1966 | Olson | 9/308 |

FOREIGN PATENT DOCUMENTS

| | | | |
|---|---|---|---|
| 557786 | 2/1957 | Italy | 9/309 |

*Primary Examiner*—Trygve M. Blix
*Assistant Examiner*—Jesus D. Sotelo
*Attorney, Agent, or Firm*—McAulay, Fields, Fisher, Goldstein & Nissen

[57] ABSTRACT

The present invention concerns articulated flippers for hands and feet, with a variable surface during swimming, for use by an amateur or a professional, as well as for subaqueous swimmers. These flippers can be used for different swimming styles, such as crawl, swimming on one side, etc. Shoes of various types which are to be put on the feet, and gloves or mitts which are to be put on hands, are used with ribs connected in a hand articulated-joint connection to the shoes and prolongations provided on four fingers of the gloves. The ribs, connected in articulated-joint connection to the shoes or wooden-shoes, and the prolongations for the fingers, support a cartilagineous surface which can open and close during swimming, thus allowing a variation of the friction surface with the water.

26 Claims, 52 Drawing Figures

ARTICULATED FLIPPERS FOR HANDS AND FEET, WITH A SURFACE VARIABLE DURING SWIMMING

BACKGROUND OF THE INVENTION

Amateur or professional swimmers, as well as subaqueous swimmers, actually use flippers which are applied only to the feet. These flippers are directly put on the feet or they form a single body with shoes to be applied to the feed. Consequently, the surface or membrane of the specific flipper, with no regard to the material out of which it is made, (rubber, more or less hard plastic, resin, etc.), remains always rigid with respect to the foot. This forces the swimmer to move and to walk in the water keeping his legs rigid, without bending his knees, and moving his legs alternatively and rhythmically. The resulting movement is not very quick.

Observing nature, and particularly the way of moving of water animals and birds, it has been noted that all these animals use, for their moving, limbs which are flexible or which they can draw back: flippers, or feet provided with membranes, for water animals; and wings for birds. Both limbs work exactly in the same way. They reduce to a minimum the friction surface in the passive stage, increasing the same to a maximum during the active stage, i.e. during the push stage. If there were not a difference in the friction surface of the moving limbs, between the active and the passive stage, there would not be any forward movement.

The same phenomenon can be observed in the case of oars of a boat. The rower submerges the oars in the water to give a thrust or push to the boat and then lifts the oars out of the water to return them to their initial position. If the oars were left in the water during the recovery or passive stage of the return of oars to their initial position, no net thrust would result and the boat would not move. In such a case, the oars would function as flippers with a rigid surface wherein the active or thrust stage would be equal to the passive or recovery stage and there would be no net movement through the water. However, when properly used, the oars are caused to provide the same function or result as a flipper with a variable surface by being lifted out of the water in the passive or recovery stage so that they provide no surface to the water during this stage, and therefore no thrust in the opposite direction to that in which the thrust is provided during the active stage.

The present invention eliminates all inconveniences and disadvantages of the prior flippers for swimmers and assures to the swimmer an optimal forward movement in the water. There are provided flippers which, when applied to the limbs (feet and hands), allow the swimmer to exploit all his energy, with movements which are natural for the human body, adapted for this purpose, as the lifting and immersing of the foot, with bending and extending of the leg, and the articulated movements of the arms.

SUMMARY OF THE INVENTION

With reference to the above, the present invention provides hand and foot flippers which, during use, open and close to provide a variable effective surface to the water. During the push or thrust part of the swimming stroke, the flippers provide a maximum surface area to provide a maximum thrust. During the recovery or passive part of the swimming stroke, the flippers close to provide a minimum surface area, thereby to minimize resistance through the water. This action is accomplished, in part by providing supports for the flipper surfaces; and incorporating articulated joints for the foot flippers.

It is another purpose of this invention to provide elastic means which facilitate a quick opening of the flipper surface and do not obstruct the closing thereof in the passive stage and allow, at the same time, the swimmer to easily walk, when coming out of the water, without taking the flippers off.

It is a further purpose of the present invention to provide releasable connecting means for connecting the surface of the flipper to its support means thereby to allow a simple mounting and dismounting. Replacement of worn surface elements is thereby facilitated.

It is another object of this invention to provide means for adjusting the tension of the flipper surface to compensate for gradual deterioration of the device during use.

It is finally a purpose of this invention to provide those flippers which are applied to the hands with means for engaging only the second and third phalanx of only four fingers of the hand, while excluding the thumb. This is to confer to the hands, according to the moving function they have, their maximum seizing features possible, so as to grip, for example, a knife or a gun.

The present invention accomplishes these aims by providing for feet and hands, a kind of articulated flipper, in which the surface thrusting against the water may vary during swimming.

With respect to the feet flipper, the present invention provides an assembly formed by two parts: a shoe in any convenient form to put on the foot, and a support provided with ribs for the support of a surface having the function of a flipper. The ribs are elastically articulated (i. e. by means of springs).

Said support is fitted on the frontal part of the shoe, or below the front part of said shoe, so that it can either be removed when ever desired, or permit it to remain permanently fixed to the shoe.

On this support are appropriately placed two or more and preferably three ribs for supporting a surface of cartilagineous membrane. These ribs, to which are applied the membrane surface of the flipper, can thus bend downward and come back taking along, when closing and opening, the membrane itself. When bent downwardly with the ribs, the membrane will display a smaller surface to the water in the direction of movement of the flipper through the water. Therefore, the swimmer can move his legs according to the natural movement of his body, bending his knees and drawing back and extending his legs. Consequently, in the first state (passive stage), the membrane closes or bends with the ribs, forming a minimum resistance to the water, while in the second state (active stage) the membrane opens to a position substantially perpendicular to the apparent movement of water past the flipper, providing the whole surface thereof for the water resistance. In this position, the swimmer will be able to generate a considerable thrust for movement through the water during the active portion of his swimming stroke. Use of the flipper will therefore provide a maximum thrust during the active portion of the swimming stroke and a minimum resistance to movement in the water during the passive or recovery part of the swimming stroke.

As to favor the opening again of the membrane in the active stage, the present invention provides springs which cooperate with the articulated-joint connection. The springs tend to keep the membrane in its open position; on the other hand, said springs are dimensioned so as not to obstruct the closing of the membrane in the passive stage.

The springs also do not have to be mounted in spring seats. In this case, the springs of the membrane in the active stage will be responsive, and the swimmer will have considerable difficulties in walking when he comes out of the water. In fact, the springs also have the function of biasing the membrane into its normally extended position.

With respect to the hands, the present invention provides for the use of gloves, preferably mitts. Rigid prolongations are only provided for the fingers, but only for four of them and not the thumb (index to little finger), and are applied thereto, as will be better shown in the drawings. Said prolongations extend the effective length of the fingers one and a half times their normal length. It is evident that the membrane, similar to the one provided for the feet, will thus have a greater extension.

It is important to note that these prolongations engage, according to the present invention, only the second and third phalanx of the fingers sheathed therein. The hand will therefore have the first phalanges free, and thus can bend more easily to facilitate swimming as well as for seizing any object.

It is also important to note that the thumb is always excluded, so that the hand mantains its seizing capability.

It is also important to note that the mitt allows, when desired, to remove the index finger from its respective prolongation, so as to better use, for example, a gun for underwater use.

It is finally important to note that the use of the flippers according to the present invention allows amateur swimmers to remain in the vertical position, with the water level at his waist, by simple movements of the flippers. Consequently, these swimmers will have a greater feeling of security.

It is understood how the flipper applied to the hand, will have—by closing and opening—the same functioning of the flipper applied to the foot.

These two combined actions will allow any swimmer an extraordinary security, a great possibility of moving and a great speed, on the surface as well as when immersed in the water.

DESCRIPTION OF THE PREFERRED EMBODIMENTS

First Preferred Embodiment

The first preferred embodiment of this invention concerns a flipper with a surface which presents a varying profile to the apparent movement of water past the swimmer during swimming. The flipper can be one which is worn on a swimmer's feet by being connected to the top of a shoe or wooden-shoe (sandle, clogg or the like). Alternatively, it can be of the type to be worn on the swimmer's hands, in the form of gloves or mittens.

In FIGS. 1 to 10, A shows the front part of the shoe or "wooden-shoe." The term 'wooden shoe' is used herein to indicate a shoe made from hard and substantially rigid materials as distinguished from flexible materials such as leather or soft plastic. The "wooden-shoe" can also be made of a bakelite or other water resistant and light material, with a thickness of one or more centimeters as required. As is readily realized, the material of which this shoe is to be made must be resistent to water and, if made of wood, should be of a type of wood which does not absorb a great deal of water and swell to change its shape. The shoe or wooden-shoe can be of any front shape, as for example circular, polygonal etc. Two or more pins E are provided on the front part of the shoe or wooden-shoe, while on the sides of the shoe or wooden-shoe, still on the front part thereof, are provided two threaded lateral bolts R, with crown or wing nuts T. Pins E and bolts R with nuts T serve to fix and block support B of the real flipper, as will be described hereinafter. Support B of the specific flipper is also made out of light and resistant material, preferably of Dural, hard wood, reinforced bakelite or similar. Said support B (FIG. 9) consists in base B′ with raised rim B″, said raised rim being at an angle to the base; the shape of said base is the same as the one of the front part A of the shoe or wooden-shoe, so that it can be perfectly adapted to the same.

Figure 4:
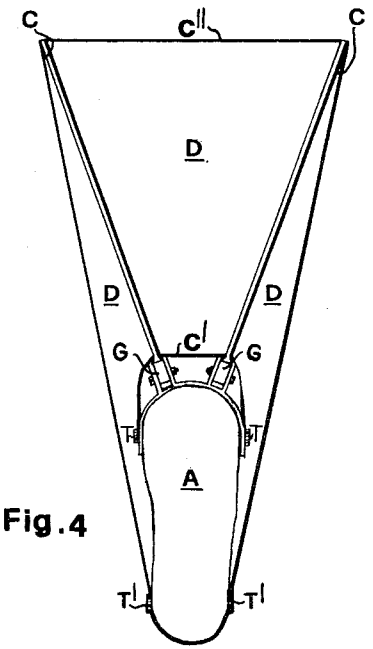
FIG. 4, is a schematic view, similar to FIG. 1, of another embodiment with only two ribs.
Figure 3:
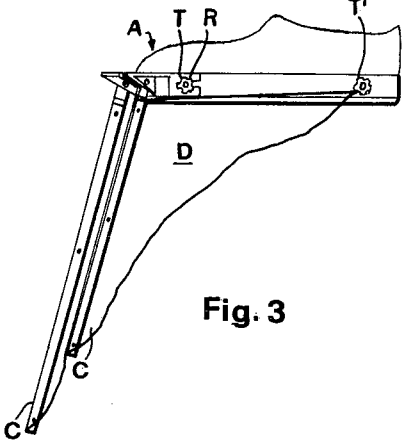
FIG. 3, is a lateral view of the flipper connected to the shoe or wooden-shoe with ribs folded-down at about 90° with respect to the sole to the "passive" position.
Figure 2:
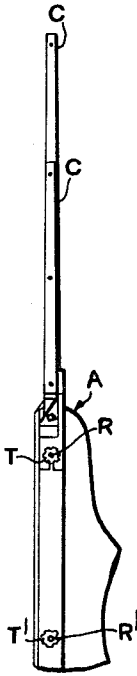
FIG. 2, is a lateral view of FIG. 1 showing the flipper in its "active" position.
Figure 10:
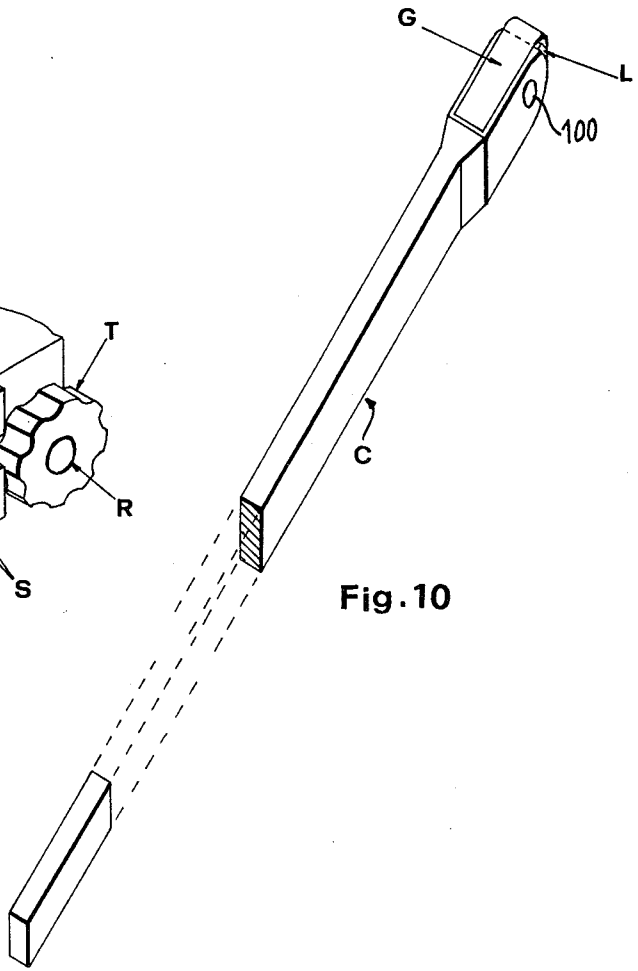
FIG. 10, is a perspective view of a rib.
Figure 9:
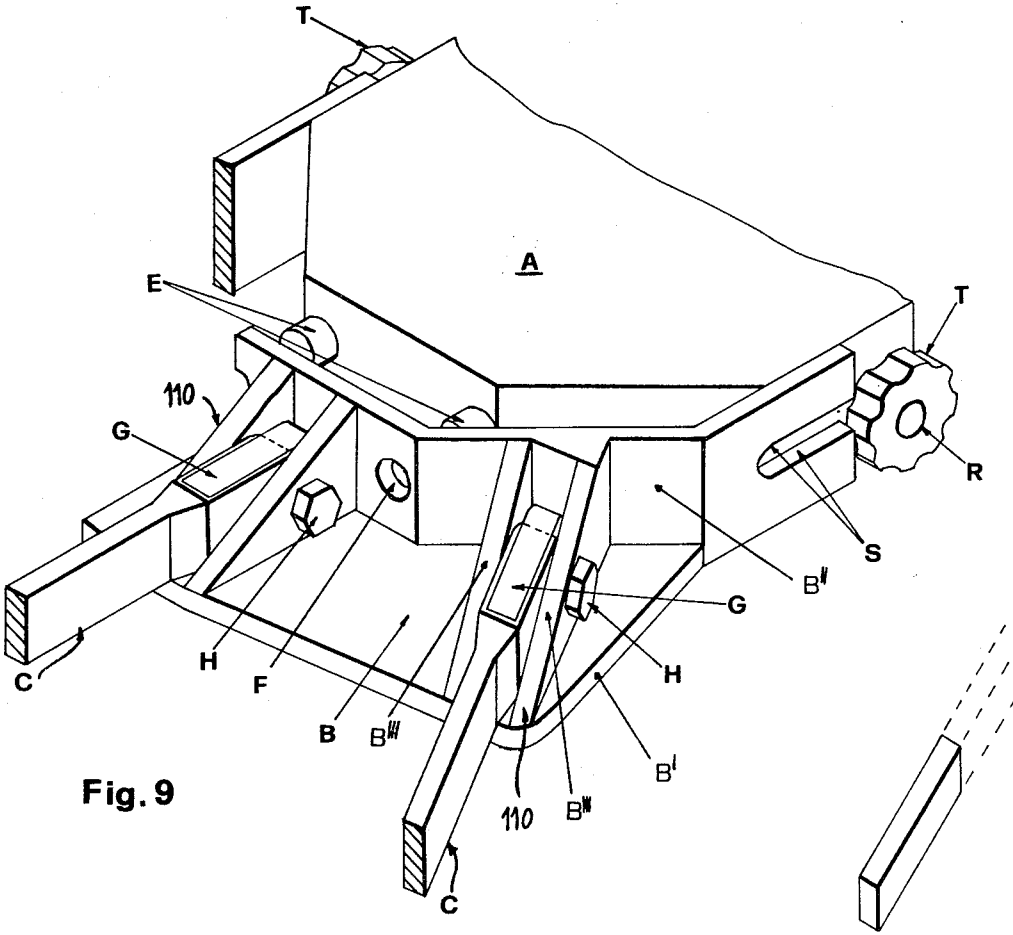
FIG. 9, is a perspective view of the front part of the shoe or wooden-shoe, having a polygonal outline, with a part of the flipper support, in the connecting stage.
Figure 11:
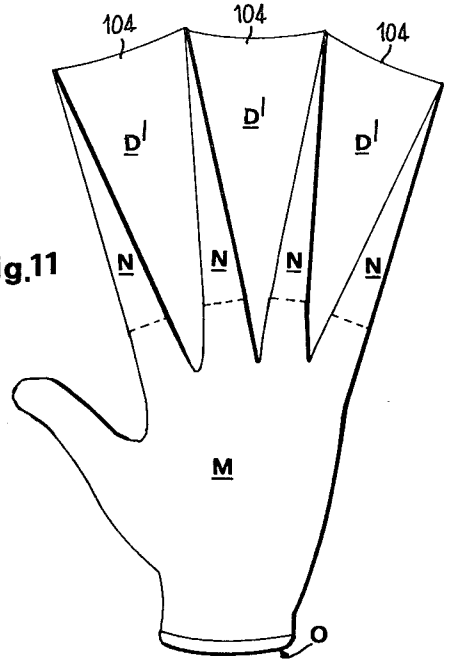
FIG. 11 is a front view of a glove having the form of a flipper, according to the present invention.
Figure 12:
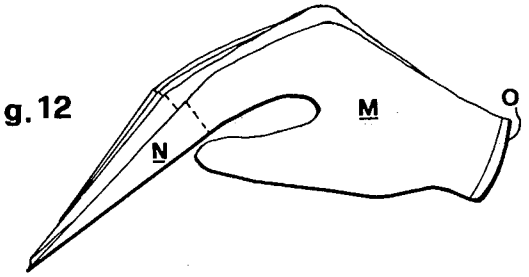
FIG. 12 is a perspective view of the gloove of FIG. 11, put on a hand shown in a bent condition.
Figure 13:
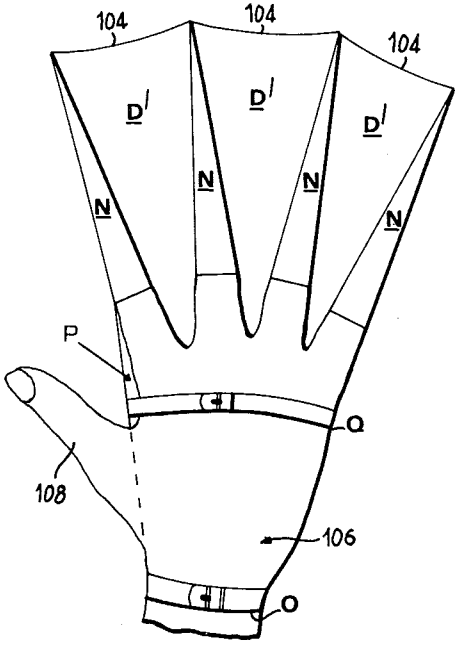
FIG. 13, a front view of a mitt having the form of a flipper according to the present invention, put on a hand shown in an unbent condition.
Figure 14:
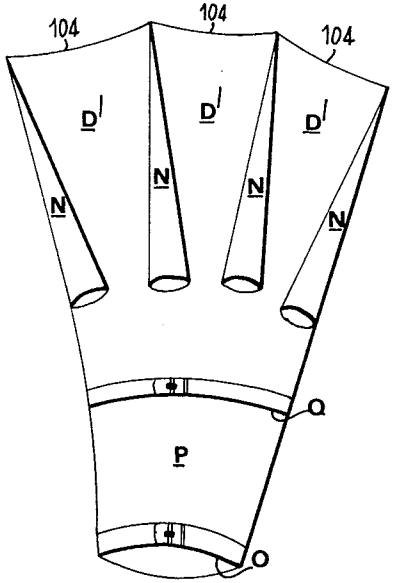
FIG. 14, is a view, similar to FIG. 13, of a mitt, which is shown without the hand inserted.

Raised rim B″ and base B′ are reinforced by means of angular reinforcing pieces B‴. As shown in FIG. 9, reinforcing pieces B‴ rest with their side against base B′, and against raised rim B″ to reinforce the block support B structure. Reinforcing pieces B‴ may be used in pairs to form guides for ribs C (FIG. 9) which are pivotally mounted therebetween on bolts H through holes 100 in ribs C (FIG. 10). Reinforcing pieces B‴ have holes 102 therethrough wherein are introduced, for the articulated-joint connections, pins H which are tightened with nuts I. The guides 110, formed by reinforcing pieces B‴ as well as threaded bolts H are provided for each rib C. Two, three or more ribs C, made out of wood which does not swell in water, or of reinforced bakelite, or of other suitable resistent and light weight material (preferably Dural) can be used. The ribs preferably have a pivoting angle or stroke of 90°, passing from the horizontal position with respect to the sole of the shoe or wooden-shoe (active position of maximum surface as shown in FIG. 2), to the perpendicular position with respect to the same sole (passive position of minimum surface as shown in FIG. 3). Ribs C are biased to their active horizontal position, with respect to the sole of the shoe or wooden-shoe, to offer to the swimmer the possibility of facilitated walking on the bench, as well as to assist the return of ribs C to their active position during swimming, by an "L" shaped flat spring G. One spring G is provided for every rib and is fixed with screws L (FIG. 7) on the back wall of the guides 110, formed by reinforcing pieces B‴. That is, spring G is in the connection area between guides 110 and ribs C and the raised rim B′. The action of these springs G is slight so that it is not felt during swimming, when passing from the active to the passive stage.

Support B is connected to the shoe or wooden-shoe utilizing both the holes F, in which pins E, provided on the shoe or wooden-shoe are inserted, and slits S, provided on both sides of the shoe or wooden-shoe. Slits S receive screws R near the front of the shoe A, which are secured by crown nuts T. Screws R and nuts T are shown. Base B′ of support B serves also as a stop for ribs C, when said ribs are placed in a horizontal position with respect to the sole of the shoe or wooden-shoe.

To form the surface of the flipper, a cartilage or a fine membrane D is applied to the back of the ribs C. The membrane D is formed of resistant and waterproof fabric, light and resistant plastic, or any other cartilagineous and resistant material. Said membrane D extends from the base of the ribs (articulated-joint connection) up to the top thereof. Membrane D is reinforced along the internal perimeter thereof as well as along the external perimeter thereof by a very resistant, preferably nylon edge C′, C″. Said two edges C′, C″ end up in two eyelets (preferably of light metal or any other light and resistant material), which eyelets will be inserted into two threaded bolts R′, fixed on both sides of the shoe or wooden-shoe, in the heel area, and tightened by wing or crown nuts T′.

With reference to FIGS. 11 to 14, M shows the gloves and P shows the mitts to be put on the hands 106. Gloves M (made out of rubber, plastic, waterproof fabric) show conical prolongations N, which prolongations can also be of any other shape; for instance said prolongations can be of pyramidal shape, for the fingers from the index to the little finger. No prolongation N for the thumb is provided, so that the hand is allowed to seize. The prolongations are of one piece with membrane D′, realized in the same material of the glove, and which consequently extends from the index to the little finger. The membrane of gloves M is also rimmed with a thread 104, more resistant than the membrane, preferably nylon. The prolongations N for the fingers, from the index to the little finger, are provided in the glove as to engage only the third and second phalanges of each one of said fingers having the first phalange free so that the hand is allowed to seize a utensil or a tool (a knife, an underwater gun, etc.). Belt O fixes the gloves to the wrist.

P shows the mitts having the same task of gloves M. Said mitts are formed by only one front membrane D, on which the palm of the hand rests. The four fingers from the index to the little finger, will enter prolongations N, out of one piece with the membrane, for the second and third phalange. The mitt will be fixed by means of belts Q and O, respectively fixed to the back of the hand and to the wrist. Also in this case the thumb 108 is excluded.

Second Preferred Embodiment

The second preferred embodiment of the present invention concerns a flipper with a surface variable during swimming, which will be permanently or detachably fixed below the shoe or wooden-shoe. Thus, the surface of support B of the first embodiment flipper will be replaced by the surface of the shoe or wooden-shoe and the area presented by the device during passive stage while swimming, will be reduced by the absence of support B.

In this second preferred embodiment of the present invention, bolts R and nuts T on the front sides of the shoe or wooden-shoe will be eliminated. Furthermore, the possibility will be given of adjusting the tension of the membrane to the feet. Finally, various kinds of springs are proposed for a quick opening of the membrane in the active stage. For the hands, only mitt-like flippers are proposed.

Figure 17:
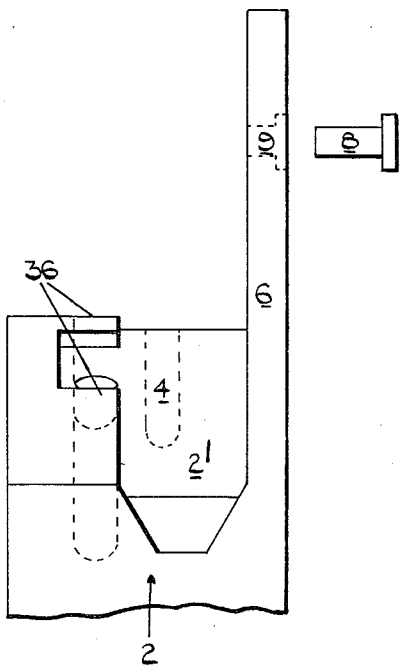
FIG. 17, is a lateral part view of the front part of the shoe or wooden shoe adapted for the permanent fitting of the flipper support.
Figure 16:
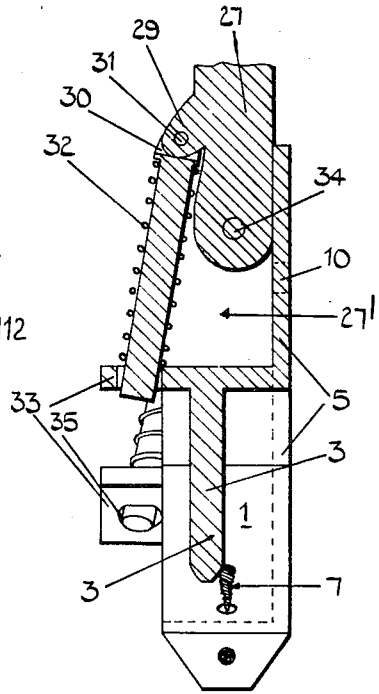
FIG. 16, is a cross-section taken along line Y–Y′ of FIG. 15.
Figure 15:
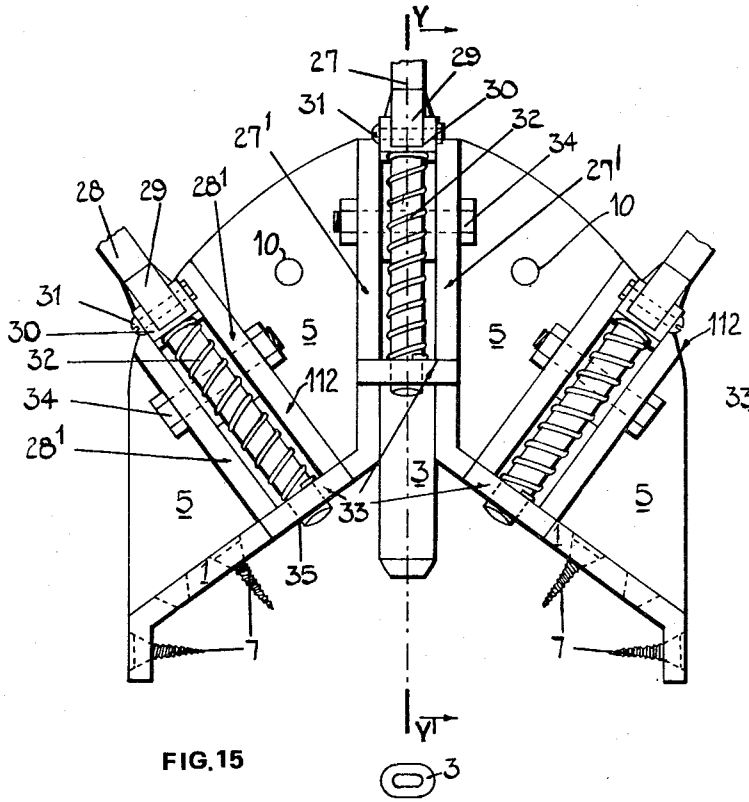
FIG. 15, is a front view of the flipper support according to another embodiment of the present invention, shown with a permanent fitting.

FIGS. 15,16 and 17 show a kind of support which can be permanently fixed to a shoe. Numeral 1 shows the shape of support 5, for application on the fitting side.

Shoe or wooden-shoe 2, made of hard wood which does not swell in the water, reinforced bakelite or hard plastic has, in this embodiment, a cut-away front part, as to form a recess in this way, a part 6 (see especially FIGS. 17,22 and 23) of the sole remains frontwardly projecting, and said projection will serve as a rest to support 5, when said support will be inserted. Said projecting part shows a groove 2′, receiving low part 1 of support 5, as well as blind hole 4 receiving oval pin 3 of support 5. Part 6 frontwardly projecting shows holes 9, said holes representing the seats for rivets 8 of soft aluminum, said rivets will take hold through holes 10 provided in the (upper) rest-base of support 5. The front cut-away part of shoe or wooden-shoe 2 finally shows blind holes 36. Said blind holes form the slits for pistons 30 of helicoidal springs 32, which will be described in the following. Support 5, which supports the frame of the flipper and the mechanic part of the articulated joints, may be formed by die-casting out of a light and very resistant alloy, preferably out of Dural. Said support is of exactly the same form and dimensions than the front of the shoe or wooden-shoe 2, and on one side it is shaped with the same profile of the front, cut-away part of the wooden-shoe, as to allow a perfect geometric connection. Furthermore, support 5, shows, always on the fitting side, low part 1, which will fit in groove 2′ of the shoe or wooden-shoe, and on oval pin 3, which will fit in blind hole 4 of shoe or wooden-shoe 2. Support 5 can thus be fitted in the cut-away part of shoe or wooden-shoe 2, and said support can be fixed therein by means of screws 7 and rivets 8. The support surface will rest on projecting part 6 of the shoe or wooden-shoe, and said projecting part has in turn a support function.

FIGS. 18 to 23 show a modification of the flipper for detachably mounting to shoe or wooden-shoe 2. In this case, a fixed hooking structural shape, shown by 11, and a removable support 16 are used for the assembly of the specific flipper. In this case, too, the shoe or wooden-shoe 2 will be frontally shaped in a way similar to the one above described. Lower shape 11′ of fixed hooking structural shape 11 is adapted to be fitted in the groove 12 of shoe or wooden-shoe 2. Fixed hooking structural shape 11 shows, at the center thereof, projection 18 with an inner groove and two lateral tabs 20; said tabs are also provided with an inner groove, for the connection with removable support 16. Fixed hooking structural shape 11, preferably made of Dural, will be permanently fixed to shoe or wooden-shoe 2 by means of screws through seats 13. Removable support 16, which supports the specific flipper assembly, is also preferably made of Dural, and said support 16 shows, on the fitting side, a shape which is identical to the shape of fixed hooking structural shape 11, as to allow a perfect geometric connection therewith. Thus, tongue 17, provided on removable support 16, perfectly penetrates groove 18 of fixed hooking structural shape 11; while end fitting parts 19 of removable support 16 penetrate between tabs 20 and projecting part 6 of shoe or wooden-shoe 2, which has the function of a rest. The surface of removable support 16 will be further fixed to projecting part 6 of shoe or wooden-shoe 2, by means of winged screws 21 passing through holes 22 of removable support 16; screws 21 take hold of nuts 14 embedded in seats 15 of projecting part 6 of shoe or wooden-shoe 2.

FIGS. 15,16 and 18,19, as well as 26 to 34 show the assembled ribs and the springs with their respective articulated-joint connections.

Figure 1:
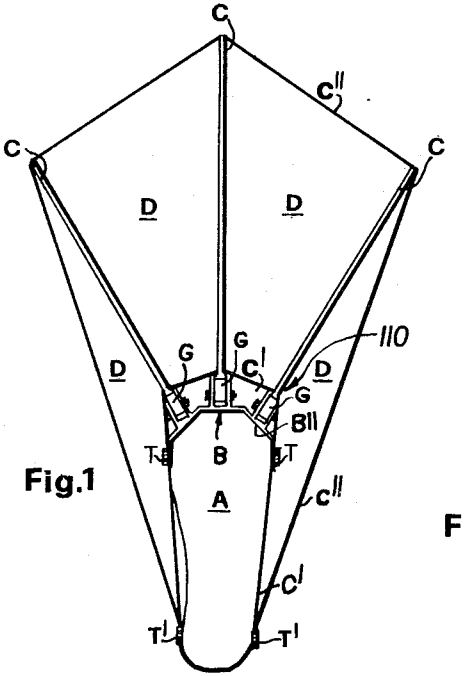
FIG. 1, is a schematic view of one embodiment showing a flipper according to the present invention, connected to a shoe or a wooden-shoe.
Figure 8:
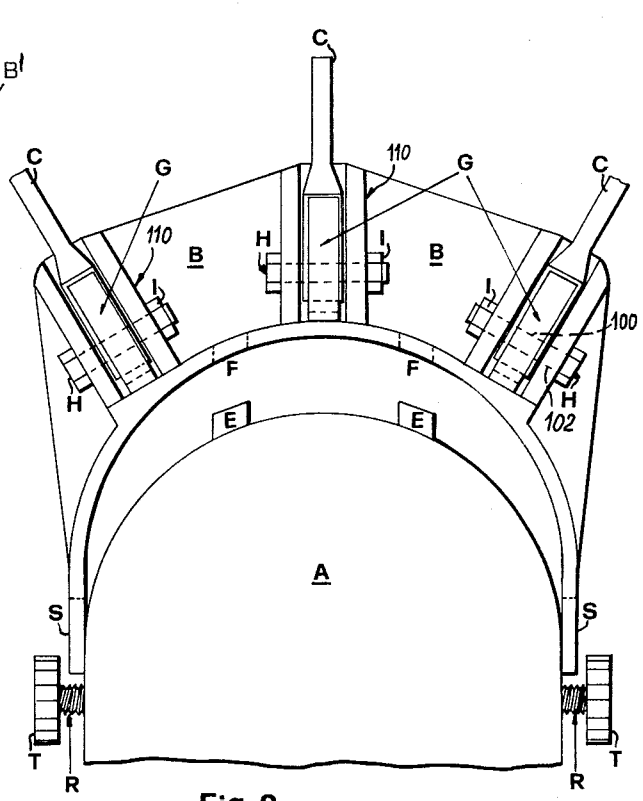
FIG. 8, is a lateral bottom view, similar to FIG. 5, of the front part of the shoe or wooden-shoe having a circular outline.
Figure 7:
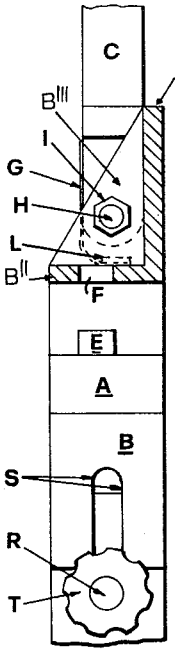
FIG. 7, is a lateral view of FIG. 5.
Figure 5:
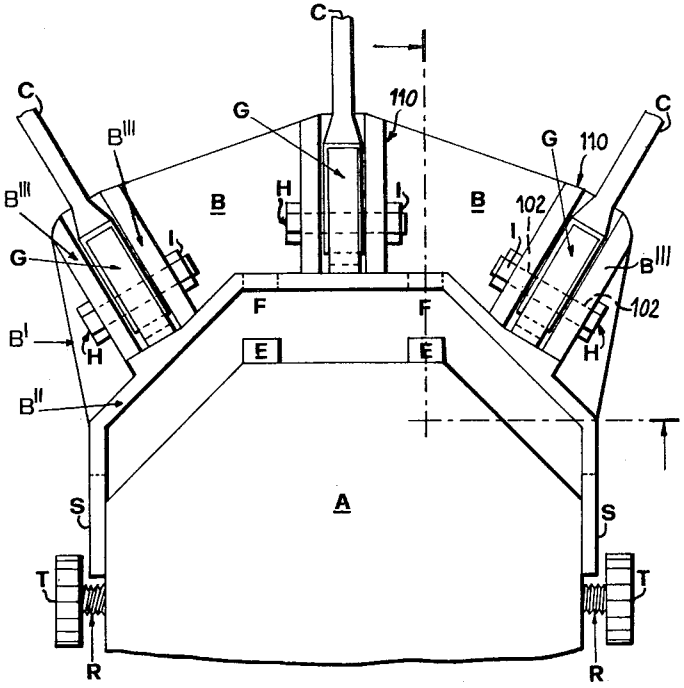
FIG. 5, is a bottom view of the front part of the shoe or wooden-shoe having a polygonal outline, with a support of the flipper in the connecting stage.
Figure 6:
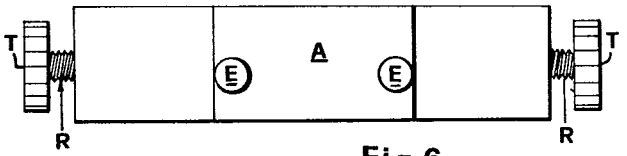
FIG. 6, is a front view of the front part of the shoe or wooden-shoe.

On the lower part of support 16 are formed, by die-casting, two lateral pairs of angular reinforcing pieces 28′, as well as a central pair of angular reinforcing pieces 27′, similar in form and function to reinforcing pieces B‴ of the embodiment of FIG. 1, a way similar to the one disclosed in the first embodiments that is, as guides for lateral ribs 28 and for a central rib 27. The ribs, which can also be only two, or even more than three, are made of the same material as the support 16. Said ribs can be of any section, preferably of rectangular section.

Figures 26, 27, 28, 29, 30, 31, 32, 33, 34:
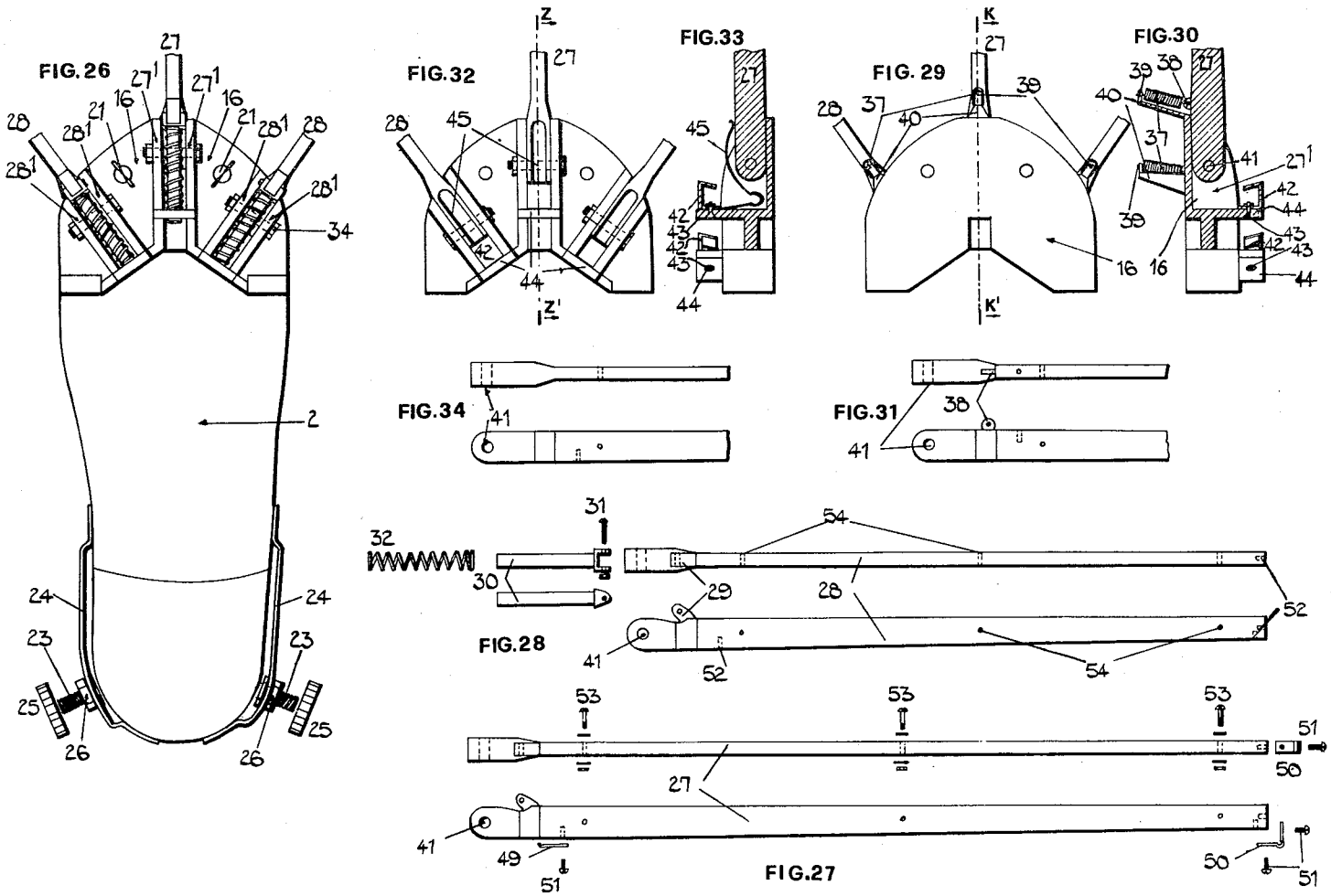
FIG. 26, is a bottom view of the sole of the wooden-shoe with a removable support fitted on a fixed hooking structural shape and screws on the sides of the heel.
FIG. 27, is a bottom and lateral view of the central rib.
FIG. 28, is a bottom and lateral view of a lateral rib of a small piston and of a helicoidal extension type springs for the articulated joints.
FIG. 29, is a top view of the moveable support with articulated joints moved by traction by helicoidal contraction type springs.
FIG. 30, is a cross-section of FIG. 29, along line K–K′.
FIG. 31, is a part top and lateral view of a rib for a traction articulated joint.
FIG. 32, is a bottom view of the moveable support with articulated joints biased by flat springs.
FIG. 33, is a cross-section taken along line Z–Z′ of FIG. 32.
FIG. 34, is a part bottom and lateral view of a rib with articulated joints biased by flat springs.

Central rib 27 is longer—in this embodiment—than the two lateral ribs 28, and is shown in FIG. 27, while FIG. 28 shows one of lateral ribs 28. Numeral 29 shows the snug, in which fits the head of piston 30, and said piston 30 is to be fixed, with threaded pin 31 with a nut, as to realize the elastic articulation. A helicoidal spring (FIG. 32) is fitted on piston 30 to provide tension. These springs are always proportioned to the length of the ribs. Obviously, the spring for central rib 27 is stronger than the springs for lateral ribs 28. Springs 32 are, furthermore, slightly longer than pistons 30, as to be shortened already in the horizontal position thereof, i.e. in the tensed position of the flipper. The compression of the springs takes place between the head of piston 30 and edge 33 of (permanent) support 5 or edge 33' of the (removable) support 16.

The ribs are introduced in opposite guides 27' and 28', and connected in articulated-joint connection therewith through hole 41, provided on the end of each rib, and bolts 34 with the nut. Pistons 30 are introduced in respective springs 32. The point of pistons 30 is introduced in hole 35 oppositely provided in the edge of (permanent) support 5 or (detachable) support 16, while the head of the piston will be fixed in snug abutment to each rib 27, 28, by a slight compression of spring 32, which is longer than piston 30. Hole 35, provided in 33 in the edge of (permanent) support 5 and (detachable) support 16, is slightly oval, as to favour the introduction of the piston during the functioning. The point of each piston, which projects from hole 35, is introduced in blind hole 36; blind hole 36 also is of oval shape, and it is provided in correspondence of said pistons in shoe or wooden-shoe 2.

According to a modification of the present invention, said helicoidal springs may work on traction instead on compression. This modification is shown in FIGS. 29, 30, and 31. In this variant, helicoidal contraction springs 37 are hooked, on one side, to eyelet 38 of the relative rib and, on the other side, to upper hole 39 of projection 40, and said projection 40 is of one piece with support 16. A stop 42, fixed by means of bolt and nut 43 on lower edge of support 16, in 44, prevents the ribs from moving at an angle of more than 90° with the plane of shoe or wooden-shoe 2.

According to a further variant of the present invention, the springs can be flat springs, similarly to the first embodiment of this invention, as above described. Also these springs are proportioned to the length of the ribs, and are shown in FIGS. 32, 33 and 34. These springs are "L"-shaped and are placed below said ribs. The springs are fixed only to one of the ends thereof, and precisely by means of bolts with nut 43, on the lower part of removable support 16, in 44. The bolts with nut 43 also support a stop 42 which similarly to the precedent variant, prevents the relative rib to perform a stroke at an angle of more than 90° with respect to the shoe or wooden-shoe.

Figure 43:
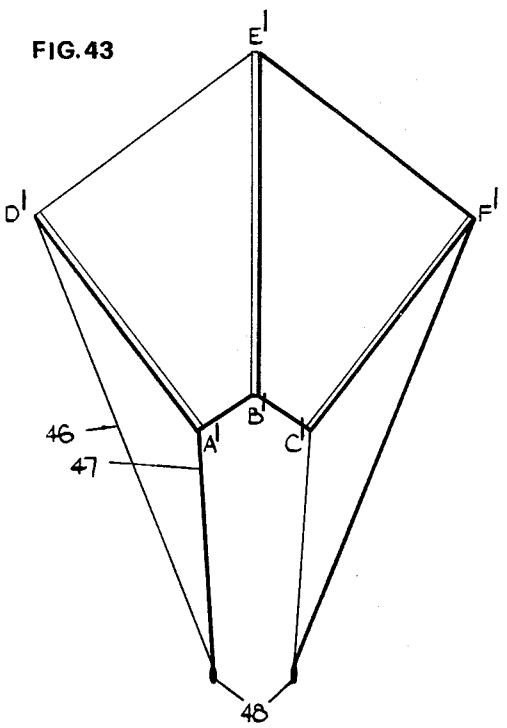
FIG. 43, is a schematic view of the wooden-shoe on which the membrane and the ribs are applied in an extended position.

The membrane of the flippers is realized in light, resistant and waterproof or plasticized cloth; the membrane's edge is reinforced with nylon yarn, of the kind used for fishing, with an adequate section. FIG. 43 shows schematically a membrane with the channels thereof for the ribs, and with the eyelets for the ends of the edges. Along the outer edge of the membrane a nylon yarn 46 is sewn or seized, while along the inner edge is sewn or seized nylon yarn 47. On the membrane are provided, out of one piece thereof, tunnels or channels with inlets, A, B, C, opened on the side of the shoe or wooden-shoe, while ends D, E, F of said channels are closed on the outer edge of the membrane.

Figure 25:
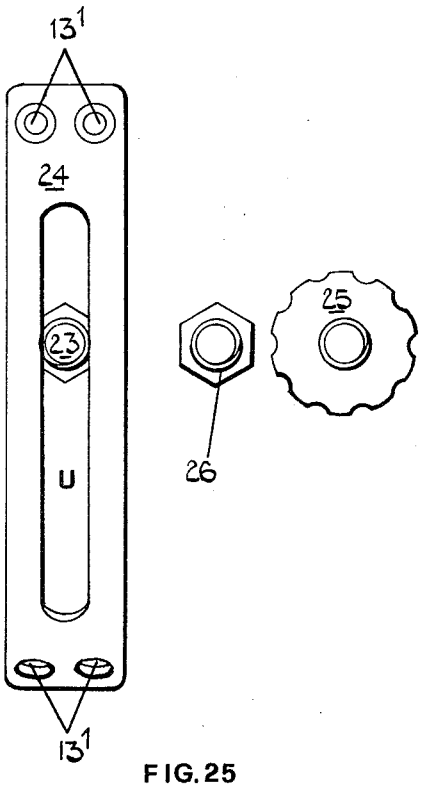
FIG. 25, is a front view of one of the guides, with connecting bolts and nuts.
Figure 24:
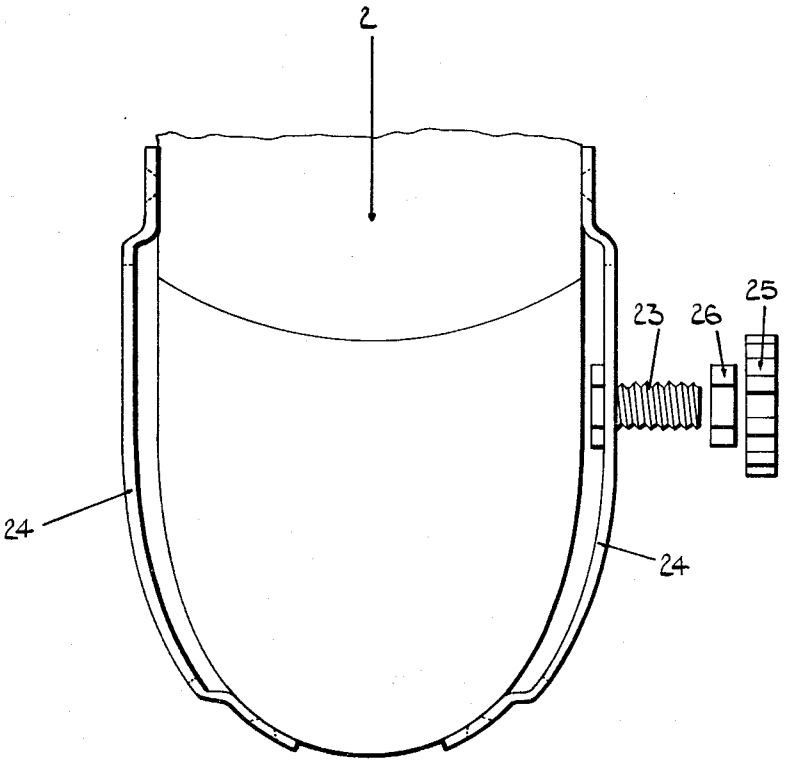
FIG. 24, is a front view of the wooden-shoe heel with guides for the adjusting of the membrane applied to the sides of the heel.
Figures 35, 36, 37A, 37B, 38A, 38B, 39A, 39B, 40, 41, 42:
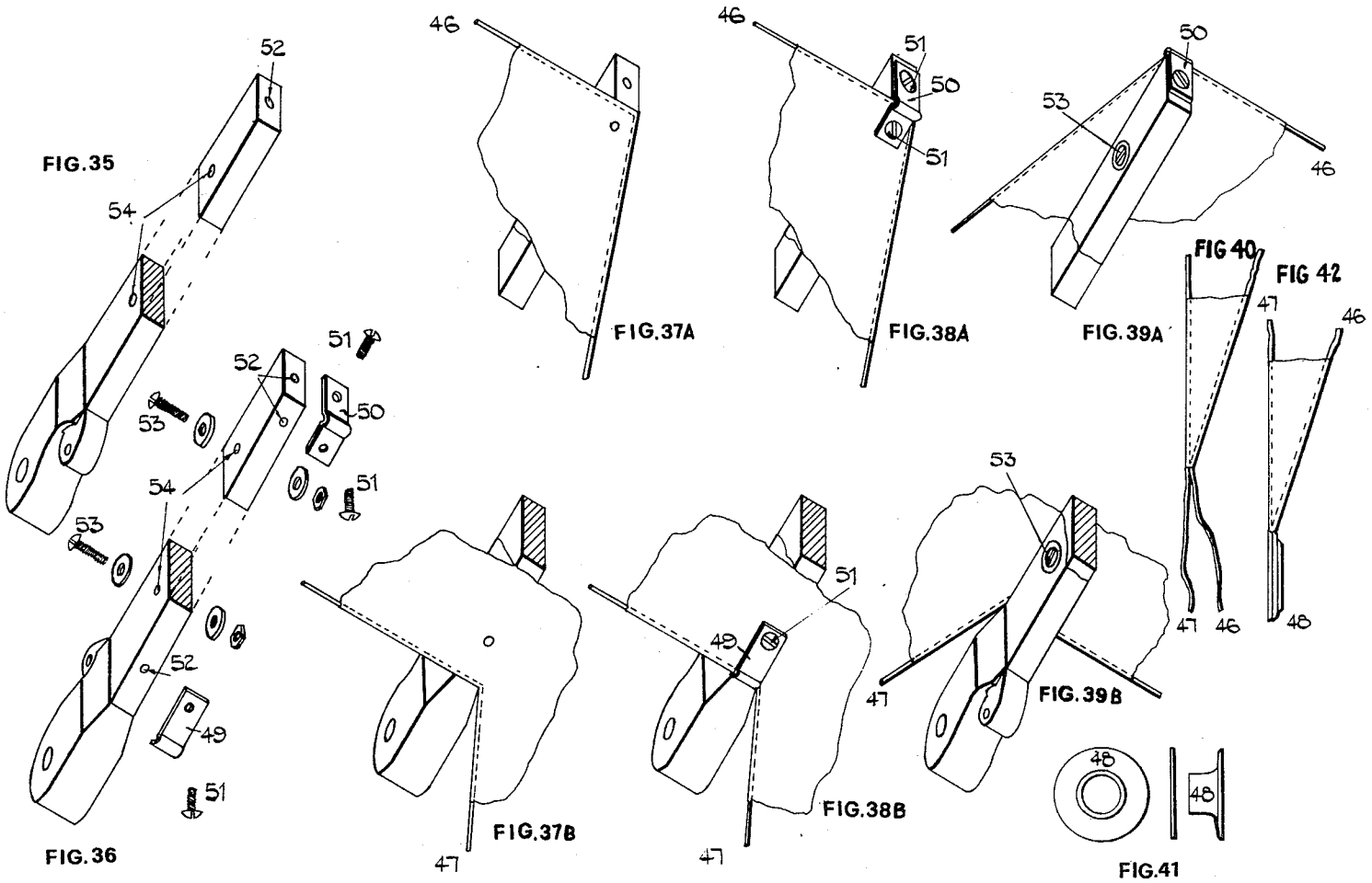
FIG. 35, is a perspective view of a rib provided with holes on the sides and on the top thereof for the fixing of the membrane.
FIG. 36, is a view similar to FIG. 35 and showing details for the fixing of the membrane.
FIGS. 37A and 37B are perspective views of the fixing of the membrane at the outer and inner end of the rib's back.
FIGS. 38A and 38B are perspective views similar to FIG. 37 with applied holdfasts for the fixing of the membrane.
FIGS. 39A and 39B are perspective views of the membrane applied on one side of a rib at the outer and inner end thereof.
FIG. 40, is a front view of the ends of the nylon yarns which are to be wound around a metal fixing eyelet on the heel of the wooden-shoe.
FIG. 41, is a front, lateral top view of a metal eyelet to fix the nylon yarns to the wooden-shoe heel.
FIG. 42, is a top view of the nylon yarns wound around the metal eyelet.
Figure 45:
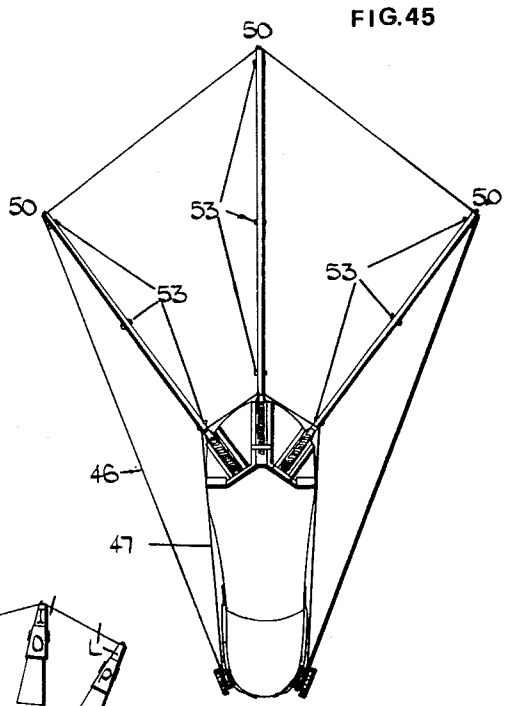
FIG. 45, is a schematic view similar to FIG. 35 with tensed helicoidal springs and edges of the membrane being fixed to the sides of the wooden-shoe heel.
Figure 44:
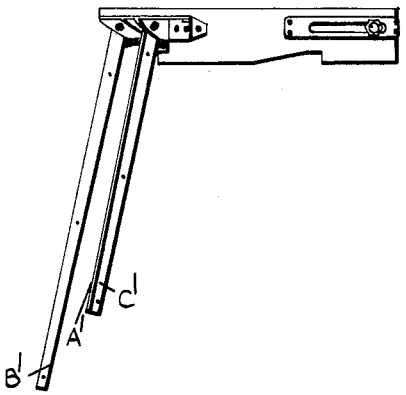
FIG. 44, is a lateral view of the moveable support provided with two ribs folded downward at about 90° with respect to the wooden-shoe sole.
Figure 48:
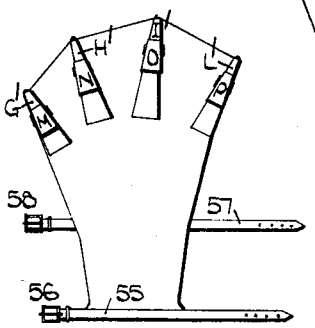
FIG. 48, is a top view similar to FIG. 47 with conical prolongations for the fingers inserted in the tubular truncated-cone parts.
Figure 47:
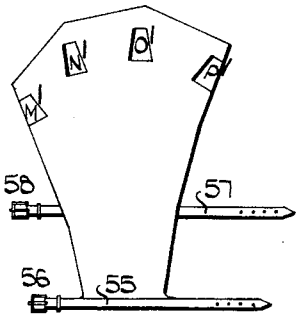
FIG. 47, is a top view of a mitt with tubular truncated-cone sections applied to the membrane and with small fixing bands to the hand-back and to the wrist.
Figure 46:
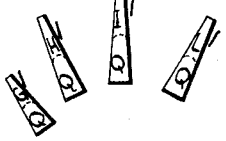
FIG. 46, is a top view of the conical thimble-prolongations, for four fingers of a hand.

The dimensions of the tunnels or channels must be of shape and measure equal to the shape and measures of the relative ribs, in which said tunnels or channels are introduced. Said ribs will therefore be introduced in said channels or tunnels. For mounting the membrane on the ribs, said ribs must be downwardly inclined at 90° with respect to the wooden-shoe (FIG. 44), and the ribs must be inserted in the channels or tunnels of the membrane. Then, the ribs may open, and the membrane may place itself in the position of maximum surface thereof (FIG. 45). Now the ends of nylon yarns 46 and 47 are drawn (FIG. 40), thus determining the approximate distance therefrom to bolt 23; said nylon yarns are twisted around eyelet 48 (FIG. 41); eyelet 48 will now be closed or squashed by means of pliers, and said eyelets will now be introduced in pins 23. The fixing of the membrane on the ribs takes place by means of simple lower holdfasts 49 and double upper holdfasts 50 (FIG. 36). Upper hold fast 50 is "L"-shaped, and the lower holdfast is a flat holdfast; said holdfasts fix the membrane and the nylon yarns, which are closed in the membrane, to the ribs by means of screws 51. Screws 51 cut holes in the membrane and they screw in threaded holes 52 provided in the ribs (FIG. 36). Holdfast 49 fixes nylon yarn 47, and holdfast 50 fixes outer nylon yarn 46 (FIG. 48). Holdfasts 49 and 50 fix the membrane on the back of the ribs. On the sides of the rib, the membrane is fixed by means of three screws 53 for each rib. Screws 53 being provided with large washers and nuts. Screws 53 pass through the membrane and through holes 54 already provided in each rib (FIGS. 35 and 36), one in the middle and two at the end of the relative rib (FIG. 39). When the membrane has been fixed, which fixing can be easily done, also in the case of a substitution when the former membrane should be broken, only eyelets 48 are to be fixed: nylon yarns 46 and 47 end up at these eyelets. FIGS. 24 and 25 show details of the membrane fixing or attaching to the side of the heel of wooden-shoe 2. 24 shows one of the two guides with an eyelet U, applied to the sides of the heel by means of screws, housed in seats 13'. Guides 24 show sliding eyelets for a bolt 23. As already said, eyelets 48 with the ends of nylon yarns 46 and 47, are introduced into over bolts 23. The membrane of the flipper will be tensioned by sliding bolt 23 along eyelet U, and fixing the same by means of lock nut 26 and crown nut 25 (FIG. 26).

FIGS. 46, 47, 48 and 49 to 52 show flippers which are to be applied to the hands. As distinguished from the first embodiment of the present invention, in this embodiment only mitts are provided, which are to be put on the hands. These mitts are formed of membrane on which are sewn or siezed tubular pieces of truncated-conical shape M', N', O', and P', corresponding to the four fingers of a hand (thumb is not included) and formed of the same material as the membrane described above. Two belts 55 and 57 are also sewn or sized on said membrane, said belts having buckles 56 and 58, as to be fixed respectively to the back of the hand and to the wrist. Within the truncated-cone shaped tubular pieces M', N', O', P' (FIG. 47), are introduced prolongations G', H', I', L' for the fingers, in a preferably conical shape (FIG. 46), made of hard wood, which does not swell much in the water, or of reinforced bakelite, or hard plastic; each one of said prolongations is as long as the length of the relative finger, with a thimble joint Q and, the length thereof is nearly half the length of the relative finger (FIG. 48). Therefore, each finger will have—once the mitt is put on the hand—a total length of one and a half time its own length. Prolongations G', H', I', L' (FIG. 48) have the same shape, dimension and angle shot of the fingers of the hand. Said prolongations will be only applied onto the second and third phalanx of each finger, leaving the articulation of the first phalanx free. Said prolongations consist in an upper part showing a cut-away 59 (FIGS. 50 and 51), in which "L"-shaped holdfast 60 will be embedded; said holdfast will be locked, by means of the two screws 61, in the frontal top area of the relative prolongation for the finger; and in the back part of the prolongation, said holdfast will fix the peripheric edge of the membrane to each of said prolongations.

Figure 52:
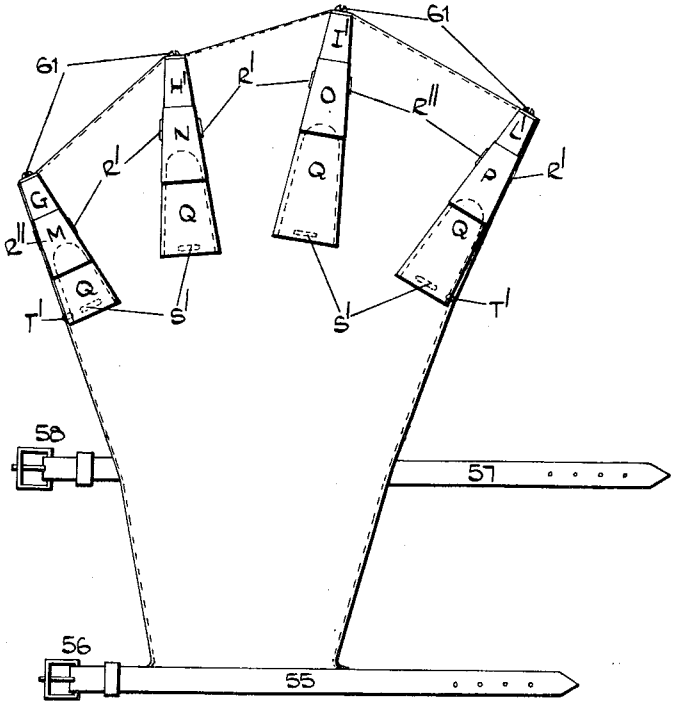
FIG. 52, is a top view of the hand membrane with fixing details of the nylon edge.
Figures 49, 50, 51:
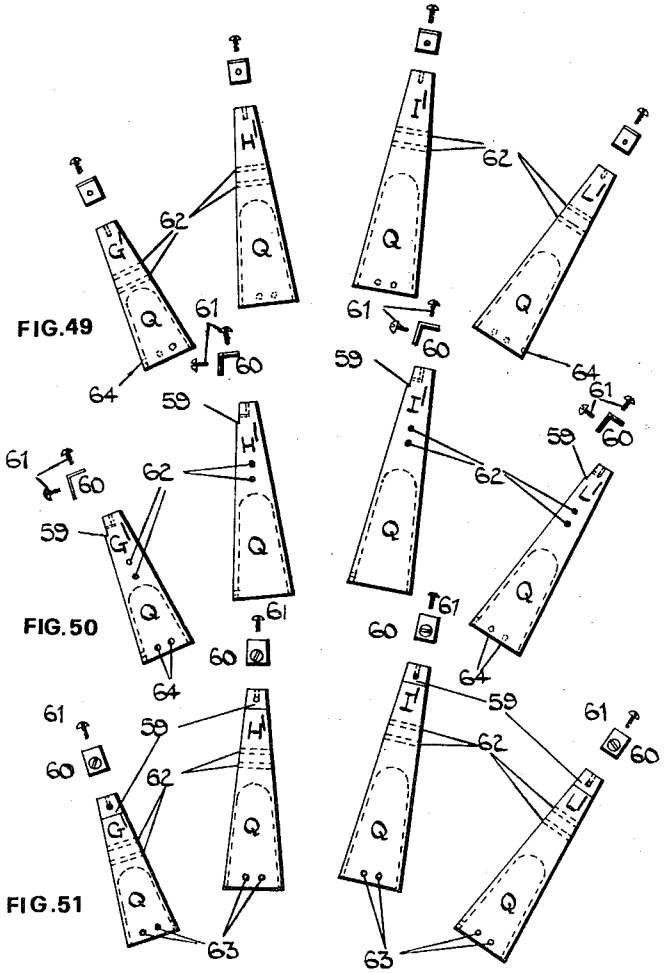
FIG. 49, is a top view of the conical prolongations for the fingers with the fixing details.
FIG. 50, is a right side view of the device shown in FIG. 49.
FIG. 51, is a bottom view of the device shown in FIG. 49.

The four prolongations G', H', I', L' show two holes 62 on the sides (FIG. 49), to fix said prolongations to the truncated-cone shaped tubular pieces by means of a seam or a fastener R' (FIG. 52). Furthermore, all of the four prolongations show further two holes 63, nearby the lower edge of the thimble joint (FIG. 51); said holes serve to connect, by means of a seam or a fastener S', the lower end of the prolongations to the membrane, on which they rest (FIG. 52). Only the two outer prolongations G' and L' show two further lateral outer holes 64 (FIG. 50), to fix the lateral edge of the membrane with the outer side of said prolongations by means of a seam or fastener T' (FIG. 52).

The functioning of the flippers for the feet is as follows. When the swimmer draws back his lower limbs (passive stage), the water pushes on the surface of the membrane, overcoming the resistance of the weak springs, and the ribs, which are liable with the membrane, are brought into a position of an angle of about 90° with the sole.

Figures 18, 19, 20, 21, 22, 23:
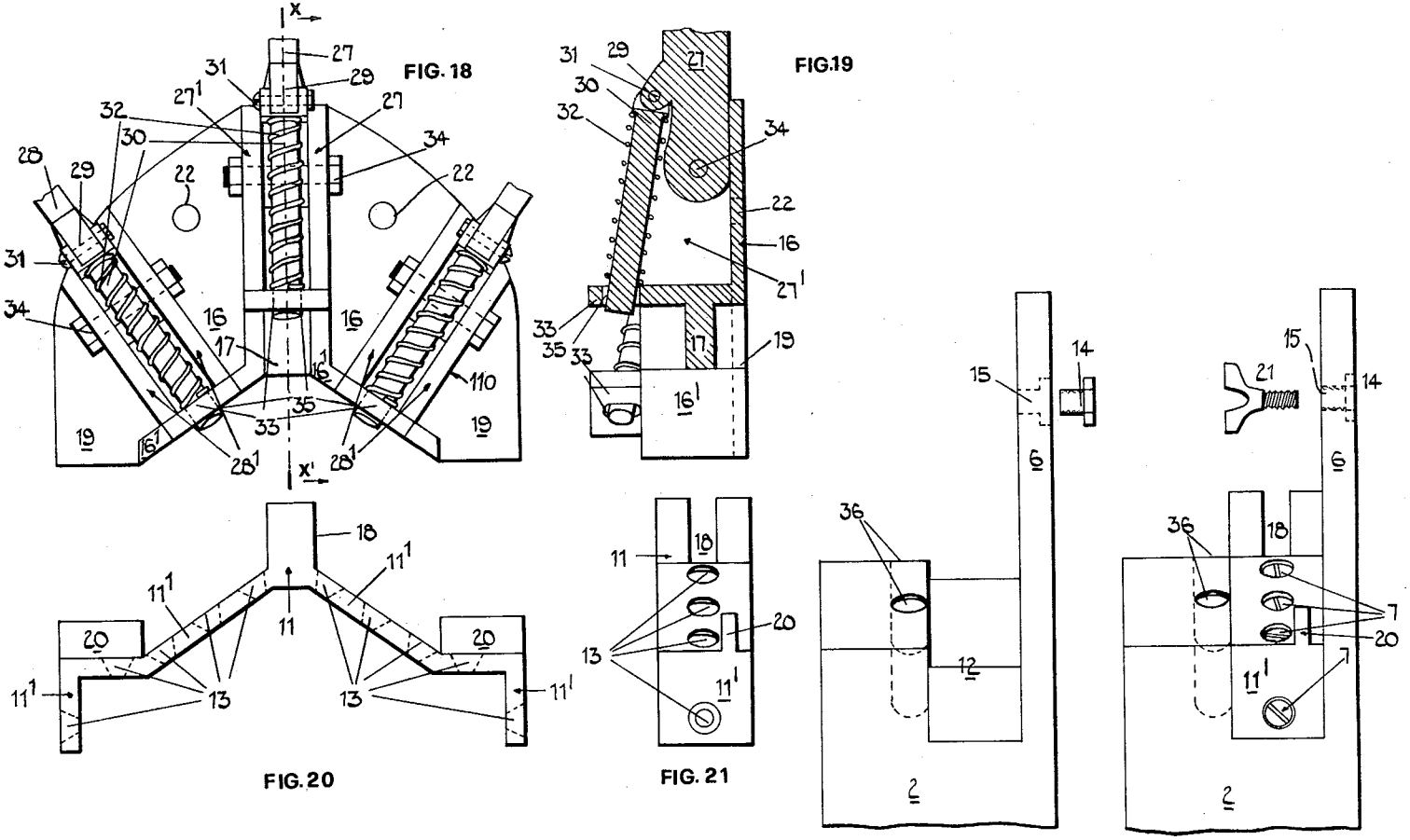
FIG. 18, is a front view of another embodiment of the invention showing the movable support of the flipper adapted for the dismountable fitting.
FIG. 19, shows a sectional view along line X–X′.
FIG. 20, is a front view of the fixed hooking structural shape fixed to the shoe or wooden-shoe.
FIG. 21, is a lateral view of the fixed hooking structural shape of FIG. 20.
FIG. 22, is a lateral part view of the front part of the shoe or wooden-shoe, provided with the dismountable fitting.
FIG. 23, is a lateral view similar to FIG. 22 with the fixed hooking structural shape connected to the shoe or wooden shoe.

In this position (passive) the membrane surface is approximately parallel to the direction of movement of the foot through the water so that its apparent surface with respect to the water is very small. When the swimmer extends his lower limbs for a forward push (active stage), the water pushes on the membrane in the opposite sense, and the springs themselves favor an immediate opening of the membrane. This brings the membrane back to the initial position, that is on the same plane as the sole of the shoe-substantially perpendicular to its direction of movement through the water. The membrane displays, in this position, its maximum surface and provides the swimmer with a considerable push. When the swimmer comes out of the water, he can easily walk—for example on the shore—as the springs, provided at the articulated-joint connections, will maintain the membrane in the completely extended position. If the swimmer prefers to detach the specific flipper, he can easily do so, by operating on nuts T (FIG. 9) or on wing screws 31 (FIG. 23).

The functioning of the gloves and mitts seems to be obvious. By closing and opening the hand, the swimmer will vary the impact surface with the water. It should be noted that the membrane forms a single surface with the prolongations for the fingers and with the same fingers, thus forming a considerable impact surface with the water. Furthermore, the exclusion of the thumb from the glove and mitt should be noted: thus the hand will keep its seizing capability. Finally, it should be noted that the prolongations of the glove, which is put only on four fingers (index to little finger), engages only the second and third phalanx of these fingers, leaving a greater mobility to the articulation of the hand.

The functioning of the mitts is similar. They provide also the possibility of quickly inserting and taking off the index of the prolongation, for example for better using an underwater gun.

Above disclosed embodiments have been shown for exemplifying purposes; it is obvious that above said embodiments can be varied and/or modified in the form, dimension, proportions, without therefore leaving the scope of the present invention.

What is claimed, is:

1. An articulated flipper arrangement, said arrangement comprising a first assembly for use on the foot of a swimmer and a second assembly for use on the hand of a swimmer: said first assembly comprising:

(a) a shoe to be worn on the foot of the swimmer including a forward toe portion and sole portion, said sole portion being aligned with the bottom of the swimmer's foot and said forward portion being disposed in front of the swimmer's foot, said forward portion having a predetermined size and shape;

(b) a flipper assembly comprising a first flexible membrane and at least two flipper ribs, said first membrane being supported on said ribs;

(c) a flipper support comprising a base with a first side being sized and shaped to receive and conform to said forward portion of said shoe, a raised edge extending upwardly from said base and along said first side, guide means operable to receive and secure said rib to said flipper support, and means to pivotably secure said rib to said support thereby to pivotably mount said flipper assembly to said flipper support;

(d) connecting means connecting said flipper support and said shoe, with said base first side and said shoe forward portion in engagement;

(e) spring means disposed between said flipper assembly and said flipper support normally biasing said flipper ribs into substantially parallel alignment with said shoe sole portion;

(f) first reinforcing edge means disposed along and reinforcing the outer and inner periphery of said first membrane;

(g) tensioning means provided on the sides of said shoe sole portion to fix and tension said first reinforcing edge means; and, said second assembly comprising:

(h) a second membrane for each hand of the swimmer, to cover each hand, except for the thumb;

(i) prolongation means for engagement with all of the four fingers of each hand, said prolongation means engaging only the third and second phalanx of said fingers;

(j) means for fixing said prolongation means to said second membrane;

(k) second reinforcing edge means disposed along and reinforcing the periphery of said second membrane;

(l) means for fixing said second reinforcing means to said prolongation means; and, (m) means for fixing said second membrane to the wrist of the swimmer, whereby said first and second assemblies cooperate when worn by the swimmer to increase the rate of propulsion of the swimmer through the water.

2. The arrangement of claim 1 wherein (a) said shoe is formed of hard material resistant to water;

(b) said connecting means for connecting to said flipper assembly and said shoe comprises two aligning pins extending from said forward portion of said shoe, and a pair of screw connectors for connecting together the aligned flipper assembly and shoe; and (c) said tensioning means comprises bolt and nut connectors provided on the sides of said shoe.

3. The arrangement of claim 2 wherein said flipper support is formed by die casting from a light, and very resistant alloy, which has the same section as said shoe at the front portion of said shoe, said flipper support further comprising two holes spaced a predetermined distance apart and so disposed as to receive said two aligning pins; two slits, one on each side, to receive and fix said bolt and nut connectors, said ribs being pivotally supported to said flipper support by pins; and said spring means being formed by an "L"-shaped flat spring fixed by means of screws to said flipper support.

4. The arrangement of claim 1 wherein said predetermined size and shape of said forward shoe portion comprises a cutaway part forming a socket groove in the forward shoe portion and a frontwardly projecting portion of said sole portion of said shoe.

5. The arrangement of claim 4 wherein said connecting means comprises a hooking structure formed in the wall of said socket-groove.

6. The arrangement of claim 5 wherein said connecting means comprises tabs provided on said hooking structure.

7. The arrangement of claim 6 wherein said flipper support is to be detachably connected to said shoe, said connecting means including end fitting parts formed on said flipper support base and being operable to extend behind said tabs and be fixed therewith; a tongue extending from a central part of said base and rearwardly from said raised edge; said raised edge having raised edge holes; winged screws operable to pass through said raised edge holes; and nuts provided in seats in said shoe, and operable to receive and secure said winged screws.

8. The arrangement of claim 7 wherein said flipper support is die cast from a light and resistant alloy, said raised edges being integral with the base of said flipper support;

said guide means being formed by a pair of lateral ribs.

9. An arrangement according to claim 8 wherein each said flipper rib is mounted to its associated pair of laterial ribs by means of a bolt with a nut, said bolt passing through a hole provided in the end of each said rib.

10. An arrangement according to claim 9 wherein said spring means comprises a helicoidal spring, the elasticity of which is proportioned to the length of the relative ribs, said spring means further comprising pistons extending through said guide means, said helicoidal springs being disposed about said pistons; said pistons being pivoted on one side to the bottom of each said flipper rib; said raised edge having oval holes in alignment with the piston ends; the other end of each said piston extending through said oval holes, said oval holes having a smaller diameter than the end of the spring to act as a seat or thrust against which said helicoidal springs can act.

11. An arrangement according to claim 9 wherein said spring means comprises a contraction type helicoidal spring; each said flipper rib includes an eyelet; said contraction spring being hooked at one end to said eyelet; a spring hole provided in said support base; the other end of said contraction spring being fixed to said spring base at said spring holes; a stop support provided on said base to prevent said rib from inclining at more than 90° from its biased open position; said stop being fixed with a bolt and nut on the end of said flipper support.

12. An arrangement according to claim 9 wherein said spring means comprises an "L" shaped flat spring fixed at one end by a bolt to said fipper support, and further comprising a stop secured to said flipper support by the same bolt as said "L" spring, the other end of said spring being free to pivot against the end of said flipper ribs; said stop being operable to prevent said rib from inclining more than 90° from its biased open position.

13. An arrangement as claimed in claim 4 wherein said shoe is to be detachably secured to said flipper support, said connecting means comprising seats for small nuts disposed in said forward portion of said shoe and frontwardly projecting therefrom, and blind holes formed in said front portion of said shoes for the passage therethrough of means pivotally securing said ribs to said flipper support.

14. An arrangement according to claim 4 wherein said shoe and said flipper assembly are to be fixedly secured together, said socket-groove having tabs provided at the outer frontal ends and a second groove provided in the outer center part thereof.

15. The arrangement of claim 1 wherein said flipper support is to be fixedly secured to said shoe and said predetermined size and shape of said forward shoe portion comprises a cut-away part forming a socket-groove in the forward shoe portion and a frontwardly projecting portion of said sole portion of said shoe, said means to seucre said ribs, and therefore said flipper assembly to said flipper support comprising an oval pin formed on said flipper assembly, a blind hole or socket formed in said shoe to receive said pin, said shoe further comprising holes for receiving screws into said raised edge of said flipper support; rivet holes in said flipper support base and said shoe whereby rivets can be used to secure said base to said shoe; and holes through said raised edge for the passage of said means pivotably securing said ribs to said flipper support.

16. An arrangement according to claim 1 further comprising channels, said channels being formed unitarily with said first membrane and out of the same material as said first membrane, said channels including open points for receiving said flipper ribs and closed points at the opposite side of said channels, said first membrane being fixed on the back and at the sides of said ribs as to project beyond said guide means to form a triangular shape.

17. An arrangement according to claim 16 further comprising a reinforcing edge passing along the outer and inner periphery of said first membrane and formed out of nylon yarn.

18. An arrangement according to claim 16 wherein said means for fixing said membrane to said ribs are a simple hold-fast secured at the inner edge and on the back of said ribs, and double hold-fasts for fixing the outer edge of the rib ends; said outer hold-fasts including screws to secure said hold-fasts to the ends of said flipper rib and bolts and nuts for fixing said first membrane on the sides of said flipper ribs.

19. The arrangement according to claim 1 wherein said tensioning means comprises an elongated guide having a slot secured to a flipper support and a guide composed of a bolt with a nut and a lock nut, said bolt being secured to said shoe and extending through said guide slot; said tensioning means being secured to said reinforcing edges and tensioning said reinforcing edges by sliding with respect to said guide bolts, said tension being fixed by tightening said nut and lock nut.

20. The arrangement of claim 1 wherein said second membrane is formed of light waterproof flexible material having a section extending a predetermined length to correspond to the distance from the wrist of a swimmer to about one and a half times the length of the swimmer's fingers.

21. An arrangement according to claim 20 wherein said prolongation means for the fingers of the diver's hands are made from hard water resistant material and extending a predetermined distance corresponding approximately to the length of the fingers of a swimmer;

said prolongations being of sufficiently large cross-section to receive the fingers of the swimmer; said prolongations havng a partially cut-away upper portion leaving a small area for fixing said prolongations to said membrane; two holes defined through said small area to receive a securing means to secure said prolongations to said membrane;

an inner extension to fit over the swimmer's fingers and increase the effective length of the fingers by one and a half times; two holes provided near the inner end of the prolongations to receive means for fixing said prolongations to said membrane; and two lateral outer holes near the outer prolongations to receive means for fixing said outer prolongations to said membrane.

22. The arrangement of claim 21 wherein said means for fixing said prolongations to said membrane comprise truncated cone-shaped pieces of the same material as said membrane sewn or otherwise seized to said membrane and said prolongations.

23. An arrangement according to claim 1 wherein said second reinforcing edge means comprises nylon yarn.

24. An arrangement according to claim 23 further comprising means for fixing said reinforcing edge to said membrane, said means comprising "L" shaped hold-fasts; and screws, said screws securing said hold fasts to said membrane and to said prolongations.

25. An arrangement according to claim 1 further comprising at least one belt with a buckle closure arrangement secured to said second membrane for securing said second membrane to the wrist of the swimmer.

26. An articulated flipper for use on the foot of a swimmer comprising:

(a) a shoe to be worn on the foot of the swimmer including a forward toe portion and sole portion, said sole portion being aligned with the bottom of the swimmer's foot and said forward portion being disposed in front of the swimmer's foot, said forward portion having a predetermined size and shape;

(b) a flipper assembly comprising a first flexible membrane and at least two flipper ribs, said first membrane being supported on said said ribs;

(c) a flipper support comprising a base with a first side being sized and shaped to receive and conform to said forward portion of said shoe, a raised edge extending upwardly from said base and along said first side, guide means operable to receive and secure said rib to said flipper support, and means to pivotably secure said rib to said support thereby to pivotably mount said flipper assembly to said flipper support;

(d) connecting means connecting said flipper support and said shoe, with said first side and said shoe forward portion in engagement;

(e) spring means disposed between said flipper assembly and said flipper support normally biasing said flipper ribs into substantially parallel alignment with said shoe sole portion;

(f) first reinforcing edge means disposed along and reinforcing the outer and inner periphery of said first membrane;

(g) tensioning means provided on the sides of said shoe sole portion to fix and tension said first reinforcing edge means.

* * * * *